United States Patent [19]

Nakamura et al.

[11] Patent Number: 4,960,670

[45] Date of Patent: Oct. 2, 1990

[54] FORMULATION OF BARCODEIN MICROENCAPSULATED DIAZO THERMODEVELOPABLE PHOTO-RECORDING METHOD UTILIZING ELECTRIC CURRENT ACTIVATED MINUTE MATRIXES TO LIGHT RECORD

[75] Inventors: Koutaro Nakamura, Shizuoka; Yoshiro Kawashima, Tokyo, both of Japan

[73] Assignee: Fuji Photo Film Co., Ltd., Kanagawa, Japan

[21] Appl. No.: 193,447

[22] Filed: May 12, 1988

[30] Foreign Application Priority Data

May 13, 1987 [JP] Japan ..... 62-117429

[51] Int. Cl.[5] ..... G03C 1/76; G03C 1/52

[52] U.S. Cl. ..... 430/138; 430/141; 430/146; 430/148; 430/151; 430/162

[58] Field of Search ..... 430/141, 146, 148, 151, 430/138, 162

[56] References Cited

U.S. PATENT DOCUMENTS

| | | | |
|---|---|---|---|
| 3,046,128 | 7/1962 | Klimkowski et al. | 430/162 |
| 3,202,510 | 8/1965 | Hollmann | 430/151 |
| 3,535,992 | 10/1970 | Goldmark et al. | 358/333 |
| 3,609,228 | 9/1971 | Goldmark et al. | 358/333 |
| 3,836,369 | 9/1974 | Looney et al. | 430/172 |
| 3,871,119 | 3/1975 | Mayer | 430/10 |
| 3,890,041 | 6/1975 | Henkler | 355/66 |
| 3,912,844 | 10/1975 | Endo et al. | 430/348 |
| 4,370,397 | 1/1983 | Ceintray et al. | 430/10 |
| 4,487,826 | 12/1984 | Watanabe et al. | 430/141 |
| 4,529,681 | 7/1985 | Usami et al. | 430/151 |
| 4,614,956 | 9/1986 | Miyauchi | 503/209 |
| 4,638,340 | 1/1987 | Iiyama et al. | 503/205 |
| 4,663,641 | 5/1987 | Iiyama et al. | 503/204 |
| 4,665,410 | 5/1987 | Iiyama et al. | 503/204 |
| 4,669,838 | 6/1987 | Hibbard | 353/26 A |
| 4,695,287 | 9/1987 | Evans et al. | 428/411.1 |
| 4,746,646 | 5/1988 | Nakanishi et al. | 428/481 |
| 4,758,547 | 7/1988 | Itabashi et al. | 503/207 |
| 4,786,948 | 11/1988 | Matsui | 355/78 |

*Primary Examiner*—Charles L. Bowers, Jr.

*Attorney, Agent, or Firm*—Sughrue, Mion, Zinn, Macpeak & Seas

[57] ABSTRACT

A thermodevelopable photo-recording method suitable for making bar-code labels, ID cards and the like, comprising using a thermodevelopable photo-recording material provided with thermodevelopable photo-recording layer containing at least a diazo compound and a coupler, and an electricity modulation type light shutter constructed by minute matrixes which come to be able or inable to transmit light when electric current is passed therethrough, and optionally an optical system for minizing or enlarging the final image, exposing said photo-recording material to light through a temporary image formed in said light shutter by turning on or off the electricity to pass through each of the minute matrixes, then heating said photo-recording material to get a record of the image therein.

1 Claim, 1 Drawing Sheet

FORMULATION OF BARCODEIN MICROENCAPSULATED DIAZO THERMODEVELOPABLE PHOTO-RECORDING METHOD UTILIZING ELECTRIC CURRENT ACTIVATED MINUTE MATRIXES TO LIGHT RECORD

FIELD OF THE INVENTION

The present invention relates to a thermodevelopable photo-recording method suitable for a printer or the like to be used particularly or making bar-code lavels and ID cards.

BACKGROUND OF THE INVENTION

In recent years, labels on which bar codes are printed have been made for attaching to commodities marked with no bar code with the intention of merchandise management utilizing bar codes. In order to make such labels, heat sensitive recording methods have been employed because they have been attained greater economy in both printer and recording paper.

On the other hand, the movement for constructing such a system as to perform various kinds of services and to direct the management utilizing informations input in ID cards by making the most of an electronic computer has gained force. Moreover, it has been tried to input desired informations in the form of bar codes into ID cards, then to read out through optical reader, and an increase in demand for the ID cards provided with portraits for identification with their respective bar codes through human eyes has been expected. In making the ID cards provided with bar codes, there have been employed various types of printers connected to the terminals of electronic computers, which are designed so as to accord with a recording method adopted, for example, a heat sensitive recording method, an electrostatic recording method, an electrophotographic recording method, and so on.

However, conventional recording methods have a problem that they cannot offer ID cards provided with bar codes, portraits, etc., and bar-code labels at both high speed and low price. In addition, bar-code labels made in accordance with conventional methods have a disadvantage that when exposed to dusts, oils and so on, or to water or some kind of solvent by experiencing such a condition as to be freezed, or so on, it frequently occurs that bar codes recorded on lables become dirty, fade away or get out of their shapes, and thereby it becomes difficult or impossible to read them with a bar-code reader. In case of a card provided with both a portrait and a bar code, the ID card of this type is used over a long period of time, and thereinto informations are input repeatedly. Further, character informations recorded therein, such as name, issue date, etc., must not be falsified. Accordingly, it is necessitated to cover not only a bar code but also the whole surface of recorded area with a thick film in making an ID card. Furthermore, form the standpoints of prevention of forgery and using by stealth, it is necessary to record a portrait, a bar code and so on in the form of integral unit so that the portrait cannot be replaced with another person's one. In order to settle this point, it is required to cover the recorded face with a transparent film, and thereby to protect the records including a bar code, etc. However, when a thick transparent film is used with the intention of giving satisfactory protection to the recorded surface, it becomes difficult to effect the recording through the transparent film. Consequently, the film must be superposed on the recorded surface, and made into a laminate. This procedure is troublesome.

Moreover, in order to laminate a film on a surface of the recording material such as bar-code labels or ID cards recorded with a bar code etc., it is necessary to use a lamination apparatus. Therefore, the intended bar-code labels and ID cards cannot be made inexpensively. In this respect also, the recording method which makes it feasible to record a bar code and other informations in the recording layer, which was previously covered with a transparent film as a protective layer, through the transparent film has been required.

As for the methods which have so far been employed for making bar-code labels and ID cards, for instance, a heat sensitive recording method made it necessary to use a thin transparent film in order to achieve the recording as the recording layer is covered with the transparent film. On the other hand, the recording of informations on the surface to be recorded through a transparent film was, in itself, impossible in the electrophotographic recording methods, the electrostatic recording methods, the inkjet recording methods, the heat sensitive transfer recording methods and so on which had been employed in conventional photoprinters, such as a laser beam printer, an LED printer, an OFT printer, an LCS printer utilizing liquid crystal shutters, and the like.

When a portrait, a bar code and character informations are intended to be recorded in an integral unit, as required of ID cards, the problems before us are as follows: Since resolutions required for clearly recording a portrait, a bar code and character informations are different from one another, and the resolving power depends, e.g., on the diameter of a thermal head or that of jetting ink in the heat sensitive recording method and the ink jet recording method, respectively, an expensive apparatus or a decrease in recording speed is required for clear recording of portraits and the like. After all, it was impossible to rapidly and cheaply record a portrait, a bar code, character informations and so on in the form of an integral unit.

As the results of concentrating our energies on solution of the above-described problems, it has now been found that even when a recording layer is covered with a thick transparent film, a bar code, characters, a portrait and so on can be recorded cheaply and rapidly by using a thermodevelopable photo-recording material provided with a thermodevelopable photo-recording layer containing a diazo compound and a coupler as primary components, and forming a temporary image utilizing as constituent units minute matrixes which come to be able to transmit light or come to be inable to transmit light when electric current is passed therethrough, and then exposing said photo-recording layer to light through said temporary image, followed by heating said recording material. Thus, we have achieved the present invention.

SUMMARY OF THE INVENTION

Therefore, a first object of the present invention is to provide a recording method which enables the clear recording of a bar code, characters, a portrait and so on even when the recording layer is covered with a thick transparent film.

A second object of the present invention is to provide a recording method best fit for printers to be used as the terminals of electronic computers, e.g., a parsonal computer, etc.

A third object of the present invention is to provide a recording method which enables the rapid, simple and cheap making of a bar-code label, and an ID card provided with both portrait and bar code.

The above-described objects of the present invention can be attained with a thermodevelopable photo-recording method in which a thermodevelopable photo-recording material provided with a thermodevelopable photo-recording layer containing at least a diazo compound and a coupler is used, and the photo-recording layer is exposed to light through an image constituted with minute matrixes which come to be able to transmit light or come to be inable to transmit light when electric current is passed therethrough, and then heated to record the image therein.

Figure 1:
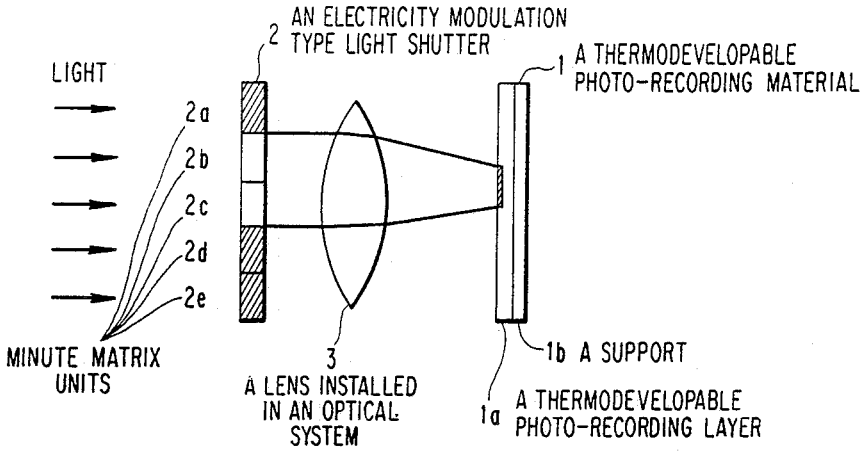
FIG. 1 is a schematic view illustrating the light recording process in accordance with the recording method of the present invention.

Therein, 1 designates a thermodevelopable photo-recording material, 1*a* a thermodevelopable photo-recording layer, 1*b* a support, 2 an electricity modulation type light shutter, 2*a* to 2*e* minute matrix units, and 3 a lens installed in an optical system.

DETAILED DESCRIPTION OF THE INVENTION

The thermodevelopable photo-recording method of the present invention is illustrated in detail in accordance with the appended figure.

FIG. 1 schematically shows a photo-recording process in the thermodevelopable photo-recording method of the present invention. Therein, 1 designates a thermodevelopable photo-recording material, 1*a* a thermodevelopable photo-recording layer, 1*b* a support, 2 an electricity modulation type light shutter which can form a temporary image, 2*a* to 2*e* each a minute matrix unit, 3 a lens installed in an optical system, and arrows rays of light for exposure.

In the thermodevelopable photo-recording method of the present invention, a thermodevelopable photo-recording material provided with a thermodevelopable photo-recording layer containing as primary components a photodecomposable color former and a color developer is employed.

In the thermodevelopable photo-recording material, various kinds of supports can be employed depending upon the end use purposes, e.g., as a label with a bar code, an ID card, etc. Specific examples of usable supports include a sheet of paper, a plastic film like a polyvinyl chloride film, etc., a sheet of metal like aluminium, etc., a support having on the back side thereof a tacky layer and a release paper, in this order, and so on. On the surface of such a support, a thermodevelopable photo-recording layer is formed directly or through a subbing layer provided for the purpose of making an improvement in adhesiveness.

The term diazo compounds as used herein refers mainly to aromatic diazo compounds, with specific examples including aromatic diazonium salts, diazosulfonate compounds, diazoamino compounds and the like. The term couplers as used herein refers to compounds of the type which contain an active methylene group in a molecule and can produce dyes by coupling with diazo compounds (diazonium salts), with specific examples including phenol derivatives, naphthol derivatives, phloroglucine and the like. These diazo compounds and couplers are used together with coupling assistants including basic substances and so on, if needed.

Details of diazo compounds, couplers and coupling assistances like basic substances, which can be used in the foregoing thermodevelopable photo-recording layer, are described, for example, in Japanese Patent Application (OPI) Nos. 39278/87, 55188/87, 55190/87 and 55191/87, and so on. These constituents are not particularly limited as to their respective compounding amounts. However, it is desirable for them that a coverage of the diazo compound is adjusted to 0.05 to 5.0 $g/m^2$, a fraction of the coupler 0.1 to 10 parts by weight per 1 part by weight of the diazo compound, and that of the coupling assistance 0 to 20 parts by weight per 1 part by weight of the diazo compound.

Among the constituents to participate in the coupling reaction, it is to be desired that at least a diazo compound should be enmicrocapsulated so as to inhibit the contact among substances to take part in the coupling reaction at ordinary temperatures, and thereby a freshness keeping property can be enhanced as the thermal producibility of color is maintained high.

For detail of enmicrocapsulating methods usable herein, compounds to constitute the microcapsules, and so on Japanese Patent Application (OPI) Nos. 291183/86 and so on can be referred to.

A temporary image to be used in the present invention is formed by a device of the type which contains as a constructing unit minute matrixes sandwitched on between transparent electrodes and capable of gaining or losing transmissibility when electric current is passed therethrough, said minute matrixes being arranged in a linear or planar form, and so-called light valves as a working part. Therein, known light valves can be used. In the present invention, for instance, an electro-optical substance, such as nematic liquid crystals, ferroelectric smectic liquid crystals, PLZT, etc., is sandwitched in between transparent electrodes comprising a transparent base and an electrodes layer made of a transparent thin film of $SiO_2$, $In_2O_3$, etc., to form an electricity modulation type light shutter for providing a temporary image.

A pattern consisting of a linear or planar part which can transmit light and one which cannot transmit light is formed by turning on or off the electricity to pass through each of the above-described minute matrix units of the electricity modulation type light shutter, and this pattern is maintained over a time interval necessary to make an image thereof in the thermodevelopable photo recording material. In this manner, imagewise exposure is carried out through the pattern formed in the electricity modulation type light shutter.

Accordingly, it is to be desired that a sharp contrast should be made between the part capable of transmitting light and the part incapable of transmitting light in the foregoing electricity modulation type light shutter. Specifically, a preferred contrast is 10 or above, particularly 20 or above, expressed in terms of the ratio of transmittance in the part by which light is transmitted and that in the opaque part.

The thermodevelopable photo-recording method of the present invention consists in the combined use of the above-described thermodevelopable photo-recording material and electricity mudulation type light shutter, wherein the recording layer of the thermodevelopable photo-recording material is brought into close contact with the electricity modulation type light shutter or located in such a position that light transmitted by the light shutter can focus into an image through a lens, a pattern consisting of the part capable of transmitting light and the part incapable of transmitting light is formed by turning on or off the electricity to pass through each of the minute matrix units which construct the light shutter, the foregoing thermodevelopable photo-recording material is exposed to light through the pattern, then the exposed recording material is heated. Particularly in the case where an optical system is arranged between the thermodevelopable photo-recording material and the electricity modulation type light shutter, it becomes feasible to change the resolving power of each record depending on the kind of information to be recorded, e.g., a pictorial image like portrait, etc., characters, a bar code, or so on. Therefore, this system has an advantage in that characters, a portrait and so on are recorded in a united condition and every recorded image has high quality.

According to the recording method of the present invention, resolution of the image to be recorded can be changed by arranging the electricity modulation type light shutter and the thermodevelopable photo-recording material so as to face each other with an optical system between. Therefore, pictorial images like portrait, etc., characters, bar codes and so on can be recorded at any time in such a condition that every recorded image can attain a resolving power necessary for recorded information, and that in a united form and with high quality.

In addition, as a temporary image for exposure, which consists of the part capable of transmitting light and the part incapable of transmitting light, is formed depending on electric signals in the electricity modulation type light shutter, the image like portrait can be recorded at high speed by connecting with a video camera or the like. Moreover, even when a thermodevelopable photo-recording layer is protected by a thick transparent film, it is feasible to record therein owing to the use of light for recording. Accordingly, the present method is applied to a printer connecting to the terminal of an electronic computer like a personal computer, etc. to result in making of high quality bar-code labels, ID cards and so on.

The present invention will now be illustrated in more detail by reference to the following example. However, the invention should not be construed as being limited to this example.

EXAMPLE

Two parts of the diazo compound illustrated below and 18 parts of a 3:1 adduct of xylenediisocyanate and trimethylol propane were added to a mixed solvent consisting of 24 parts of dibutyl phthalate and 5 parts of ethyl acetate, and dissolved thereinto. The resulting solution was mixed with a water solution composed of 3.5 parts of polyvinyl alkohol, 1.7 parts of gelatin and 58 parts of water, and dispersed thereinto in the form of emulsion having an average droplet size of 3 microns.

100 parts of water was further added to the emulsion obtained, and then the resulting emulsion was heated to 40° C. with stirring over a period of 2 hours. Thus, microcapsule solution containing the diazo compound as core material was obtained.

(Diazo Compound)

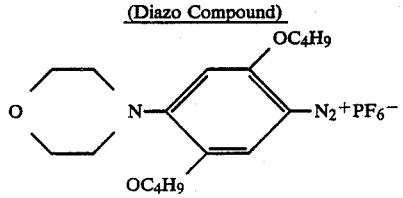

Separately, 20 parts of 2-hydroxy-3-naphthoic acid 3'-morpholinopropylamide (as a coupler) was added to 100 parts of a 5% water solution of polyvinyl alcohol, and dispersed thereinto by means of a sand mill over a period of about 24 hours to prepare a coupler dispersion having an average particle size of 3 microns.

Further, 25 parts of p-t-butylphenol was added to 100 parts of a 5% water solution of polyvinyl alcohol, and dispersed thereinto using a sand mill over a period of 24 hours to prepare a dispersion of p-t-butylphenol having an average particle size of 2 microns.

To a 50 parts portion of the thus obtained microcapsule solution of the diazo compounds were added a 15 parts portion of the dispersion of the coupler and a 30 parts portion of the dispersion of p-t-butylphenol. The thus prepared coating composition was coated on smooth wood-free paper (having a basis weight of 50 g/m$^2$) so as to have a dry coverage of 20 g/m$^2$ according a bar coating process utilizing a coating rod, and dried by heating at 45° C. for 30 minutes to form a thermodevelopable photo-recording layer.

On the other hand, a liquid crystal panel was employed as the electricity modulation type light shutter, and it was brought into a close contact with the above-described photo-recording layer in the dark. The light shutter was made to put out an appropriate character pattern, and the pattern was maintained therein. Then, the resulting light shutter was exposed to a fluorescent lamp installed as a light source in Ricopy Super Dry 100 (made by Ricoh Co. Ltd.) for 10 seconds. Subsequently, the optically exposed thermodevelopable photo-recording material was passed between rollers heated at 100° C. Thus, the developed color image corresponding to the foregoing character pattern was obtained.

What is claimed is:

1. A process for the preparation of a bar-code label or ID card recorded with a bar code using a thermodevelopable photo-recording material comprising a support having thereon a thermodevelopable photo-recording layer containing at least a microencapsulated photodecomposable diazo compound and a coupler capable of reacting with the diazo compound to form color, said diazo compound and coupler being present in sufficient quantity to form a color image upon processing, and a protective transparent film provided on the photo-recording layer comprising the steps of imagewise exposing said photo-recording layer to light through an image to be copied constituted with minute matrixes which come to be able to transmit light or come to be unable to transmit light when electric current is passed therethrough to decompose the diazo compound in the exposed portions of the photo-recording layer, and then heating said photo-recording material to form a color image in the unexposed portions of the photo-recording layer such that a bar code is obtained.

* * * * *